United States Patent [19]

Wharton

[11] Patent Number: 4,557,482

[45] Date of Patent: Dec. 10, 1985

[54] PUZZLE COMPRISING INTERCONNECTED ARCUATE CHANNEL MEMBER

[76] Inventor: Peter S. Wharton, 4 Gordon Pl., Middletown, Conn. 06457

[21] Appl. No.: 669,467

[22] Filed: Nov. 8, 1984

[51] Int. Cl.[4] ..... A63F 9/08

[52] U.S. Cl. ..... 273/109; 273/153 S; 434/278

[58] Field of Search ..... 273/109, 153 S; 434/278

[56] References Cited

U.S. PATENT DOCUMENTS

| | | | |
|---|---|---|---|
| 601,924 | 4/1898 | Trull | 273/109 |
| 1,206,054 | 11/1916 | Hicks | 273/109 |
| 3,677,547 | 7/1972 | Wilson | 273/109 |
| 4,008,895 | 2/1977 | Reiner et al. | 273/113 |
| 4,413,823 | 11/1983 | Breslow | 273/153 S |
| 4,487,415 | 12/1984 | Wilfong | 273/153 S X |

FOREIGN PATENT DOCUMENTS

| | | | |
|---|---|---|---|
| 82/03792 | 11/1982 | Int'l Pat. Institute | 273/153 S |
| 83/00634 | 3/1983 | Int'l Pat. Institute | 273/163 S |

*Primary Examiner*—Anton O. Oechsle

*Attorney, Agent, or Firm*—St. Onge Steward Johnston & Reens

[57] ABSTRACT

A puzzle device is provided which comprises a series of channels, formed around the surface of a spherical core by a series of transparent hollow arcuate members, having two diametrically opposed points of intersection forming chambers. A plurality of spherical puzzle members is disposed in surface to surface contact within said channels. With the puzzle disposed with the chambers located on a vertical axis the lowermost puzzle pieces in each of the channels are in contact with each other and one puzzle piece is located in the uppermost chamber and is supported herein by contact with the uppermost of the puzzle pieces in at least one of the channels. Rotation of the puzzle through 180° in the plane of one of said channels causes the latter puzzle piece to be directed into that channel and, simultaneously, a puzzle piece originally located in the lowermost part of the same channel is caused to enter the chamber which has become the uppermost after the rotation has been completed. The puzzle pieces are present as groups the members of each group having visually identifiable characteristics. An object of the puzzle is to rearrange the puzzle pieces by successive 180° rotations so as to achieve any predetermined arrangement of the visually distinguishable groups in the various channels.

18 Claims, 8 Drawing Figures

PUZZLE COMPRISING INTERCONNECTED ARCUATE CHANNEL MEMBER

BACKGROUND OF THE INVENTION

1. Field of the Invention

This invention relates to a ball puzzle device and is more particularly concerned with a ball puzzle in which the balls are subject to rearrangement within a series of continuous intersecting passageways disposed on the surface of a sphere.

2. Description of the Prior Art

Puzzle devices which involve the rearrangement of groups of colored balls in passageways are well known in the art. For example, U.S. Pat. No. 601,924 (Wilson) shows a box-like puzzle having a base tapering towards its center and having a series of balls located in the box. One of the balls is of larger size than the rest and is located in the center of the box. The other balls are divided into two sets of different colors. The object of the game is to rearrange the balls in any predetermined manner by passing the balls one at a time over or around the center ball.

U.S. Pat. No. 1,206,054 (Trull) shows a puzzle with a base having a series of grooves extending from a central point and adapted to accommodate differently colored balls. The object of the exercise is to rearrange the balls within the various grooves to achieve any predetermined pattern. U.S. Pat. No. 3,677,547 (Hicks) shows a more sophisticated version of the Trull device in which the grooves are retroverted. In addition, the various passageways can have sliding gates which can be used to retain the balls in any of the passageways.

U.S. Pat. No. 4,008,895 (Reiner et al.) describes a maze which comprises a network of three-dimensional passageways through which marbles are permitted to pass. Certain of the passageways contain exits through which the marbles can pass to the outside of the puzzle. The object of the exercise is to cause the marbles to pass through the maze without escaping from any of the apertures.

U.S. Pat. No. 4,413,823 (Breslow) discloses a ball puzzle which has two members rotatably joined to each other. Each of the members has a number of passageways and these passageways are spaced so that only one in each member can be aligned with a passageway in the other member at any given time. All of the passageways may contain balls and the object of the exercise is to transfer balls from passageways in one member to passageways in the other member to achieve any predetermined arrangement of the balls.

The ball puzzle devices previously known are generally of relatively simple design and construction and are not based on mathematical relationships of any degree of sophistication. The present invention relates to a device of more sophisticated construction which embodies a design based on a relatively sophisticated set of mathematical relationships. The present invention also relates to a device which is markedly more challenging and requires a higher degree of sophistication for its solution. The device, broadly speaking, is a three-dimensional variation of the well known 15-puzzle. In the latter puzzle fifteen small, numbered, square tiles of identical size are confined to the surface of a larger square which can just accommodate sixteen square tiles in a 4 by 4 matrix. By sliding tiles in turn into the one empty space the sequence of the tiles is changed. The challenge is to rearrange the tiles, starting from a random sequence, into a specified sequence. The widely acclaimed Rubik's cube TM is a three-dimensional variation of the 15-puzzle. The puzzle device of the present invention is similar to these known devices in its degree of challenge and sophistication.

Further, the present invention, like Rubik's cube TM but unlike previously known ball puzzle devices, relates to a puzzle device which is so designed and constructed that it presents not one but two independent and relatively sophisticated challenges, one of solving the puzzle (requiring relatively little manual dexterity) and the other of effecting complete solutions, once they have been learned or otherwise obtained, with great rapidity (requiring a high level of manual dexterity).

SUMMARY OF THE INVENTION

It is an object of the present invention to provide a new and improved ball puzzle.

It is a further object of the invention to provide a new and improved puzzle which can be constructed readily and can be transported easily.

It is a further object of the invention to provide a puzzle in which the player is required to rearrange in any predetermined fashion a plurality of balls disposed in a continuous three-dimensional network of passageways.

More particularly, the puzzle of the present invention comprises:

- a plurality of hollow arcuate members disposed about a substantially spherical member and cooperating therewith to form a series of channels;
- each of said channels communicating, at each end thereof, with each of the other said channels via common chambers;
- said common chambers being disposed on substantially diametrically opposed sides of said spherical member;
- a plurality of substantially spherical puzzle pieces of substantially uniform size disposed throughout each of said channels;
- an additional substantially spherical puzzle piece of the same size as the other said puzzle pieces;
- said additional puzzle piece being located in the uppermost of said common chambers, when said puzzle is oriented with said common chambers disposed on a vertical axis, and being supported by contact with at least one of the uppermost puzzle pieces in said channels;
- the relative positions of said puzzle pieces and said additional puzzle piece being changeable incrementally upon rotation of said puzzle device through 180° in the plane of any one of said channels with said common chambers disposed on a vertical axis before and after rotation.

As will be discussed below, the puzzle device can be adapted to provide puzzles of varying degrees of challenge. For example, by providing that the various puzzle pieces are divided into appropriate groups which are colored or marked distinctively, it is possible to provide a game in which the challenge is to arrange each of the members of any particular group in a particular channel within the puzzle device.

DETAILED DESCRIPTION OF THE INVENTION

Figure 1:
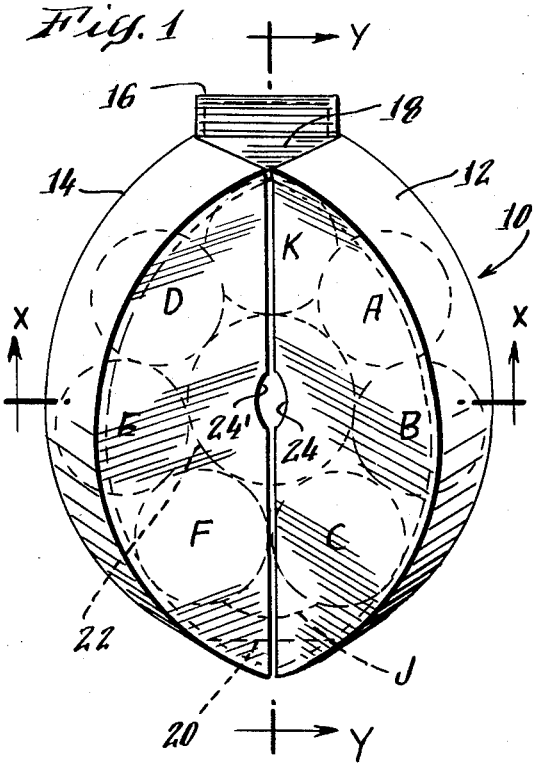
FIG. 1 is a perspective side view of a game or puzzle device in accordance with the invention.
Figure 2:
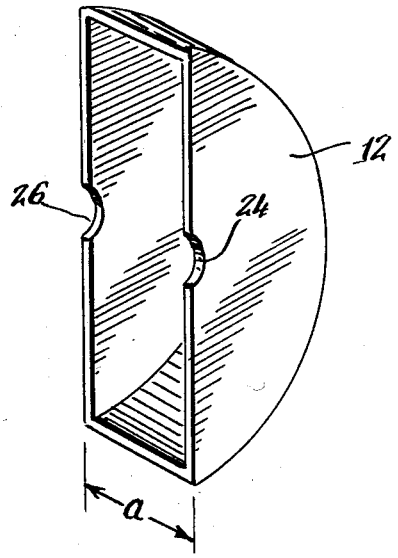
FIG. 2 is a perspective view of a hollow channel member forming part of the device shown in FIG. 1.

Turning now to the drawings, FIG. 1 shows a particular embodiment of a game constructed in accordance with the invention. In this particular embodiment the game (10) is shown as provided with three hollow arcuate members (12), (14) and (16) and these members are joined together at each end thereof by triangular end plates (18) and (20). In the particular embodiment shown in FIG. 1 in perspective view, the end plates (18) and (20) are equilateral triangles and hence the three hollow members (12), (14) and (16) are disposed in substantially symmetrical arrangement about a vertical axis drawn between the center points of the end plates (18) and (20). FIG. 2 shows the mode of construction of one of the hollow members (12) shown in FIG. 1. In the particular embodiment of FIG. 1, all three hollow members are identical in configuration.

Figure 3:
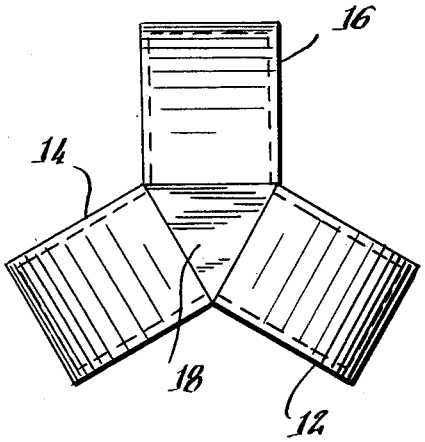
FIG. 3 is a horizontal plan view looking down at the top of the embodiment shown in FIG. 1.

FIG. 3 illustrates a plan view taken from vertically above the end plate (18) of the game device (10) shown in FIG. 1. The numbering of the various elements in FIGS. 2 and 3 corresponds to that used in FIG. 1.

Figure 1A:
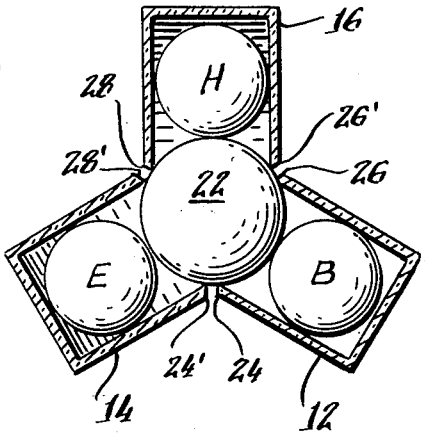
FIG. 1A is a cross-sectional view, taken along the line X—X, of the puzzle device shown in FIG. 1.

Referring again to FIG. 1, a spherical member (22) is disposed approximately centrally within the game (10). The spherical member (22) has a diameter which is slightly larger than the width "a" of the channel members (12), (14) and (16) and is held loosely in place in the center of game (10) by projecting into the small pockets formed by arc-shaped cutouts (24) and (24') which are centered on the adjoining edges of arcuate members (12) and (14) as well as on the corresponding edges of the hollow members (14) and (16) and of (16) and (12). This means of loosely maintaining the spherical member (22) in place can be seen more clearly by reference to FIG. 1A which is a cross-sectional view of the embodiment shown in FIG. 1 taken through the line X—X. In FIG. 1A it will be seen that the arc-like cutouts (24) and (24') in the adjoining edges of the hollow members (12) and (14) respectively are provided with outwardly beveled edges which can engage the surface of the spherical member (22) and on which the spherical member can slide or roll. In similar fashion there are provided arc-like cutouts (26) and (26') and (28) and (28') on the adjoining edges of hollow members (12) and (16) and of members (16) and (14) respectively.

While the precise shape and dimensions of the arc-like cut-outs are not critical, it is preferred that they are such as to allow the spherical member (22) to travel a short distance vertically when the device (10) is rotated through 180° during operation of the device as described below. Thus, in the particular embodiment shown in FIG. 1 the spherical member (22) is positioned such that it is offset slightly below the center of the device (10) and, after the device has been turned upside down, the spherical member (22) has moved vertically downwards so that it is again offset slightly below the center of the device (10). The arc-like cutouts also are of such dimensions and shape as to allow the spherical member (22) a certain amount of lateral freedom of movement and, in a preferred embodiment, the spherical member is free to slide or roll on the edges of said cutouts.

Referring once again to the embodiment of the game (10) shown in FIG. 1, there is disposed about the spherical member (22) a set of puzzle pieces. These puzzle pieces are also substantially spherical in shape and have substantially smooth surfaces in a preferred embodiment, although the surface can be dimpled or indented in any appropriate manner provided the overall shape of the piece is spherical. In the particular embodiment shown in FIG. 1 there are present three such spherical puzzle pieces in each of the hollow members. These are identified as A, B and C located in the hollow member (12) and as D, E and F in the hollow member (14). There are also three puzzle pieces G, H and J located in the hollow member (16) although these cannot be seen in the perspective view shown in FIG. 1 except for the very lowest tip of the lowermost piece which is partially visible. A tenth puzzle piece K is shown located in the uppermost chamber and resting on the spherical member (22) in a position referred to hereinafter as the "apical" position.

All of the spherical puzzle pieces disposed around the spherical member (22) have substantially the same dimensions and all are smaller in diameter than the spherical member (22). In general, the dimensions of the puzzle pieces are such that they may travel freely within the walls of the hollow members (12), (14) and (16) but are not of such a small dimension that any one puzzle piece can pass by another puzzle piece within the channels formed by the said hollow members.

Although it has not been specifically stated heretofore, it will be apparent that, in order for a player to operate the game, it is necessary to be able to see the individual game pieces within the device. Clearly, therefore, the hollow members (12), (14) and (16) should be fabricated from transparent or semi-transparent material. Advantageously, such material can be a plastic material such as Plexiglass and the like. The end plates (18) and (20) can also be prepared from the same or similar materials. The hollow members and the end plates can be fabricated by cutting from sheets and assembling the various components using adhesive and the like. Alternatively, the various components can be molded from an appropriate plastic of an appropriate hardness. As will be obvious to one skilled in the art, the configuration of the outer surfaces of the hollow members (12), (14) and (16) and of the end plates (18) and (20) can take any desired form. It is only the configuration of the interior of the said hollow members which is important, as will be discussed more fully below.

Figure 5:
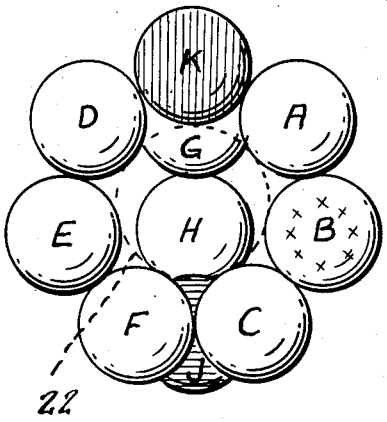
FIG. 5 is a schematic representation of the puzzle pieces arranged within the puzzle device shown in FIG. 1.

In order to illustrate more clearly the arrangement of the ten puzzle pieces shown in the game (10) in FIG. 1 there is shown in FIG. 5 in schematic form the manner in which these game pieces are oriented around the spherical member (22) which is shown only in dotted lines in said schematic representation. There can be seen in FIG. 5 the three puzzle pieces G, H and J which are located in the hollow member (16) in FIG. 1 and which could not be seen in the view there set forth. It will be seen that the three puzzle pieces F, C and J, which are the lowermost pieces located in each of the three hollow members, are in contact with one another and form the base of what is essentially a symmetrical polyhedron. The other two puzzle pieces in each of the three hollow members are supported one above the other on top of one of the lowermost trio of puzzle pieces. The tenth member of the puzzle pieces, namely piece K, is in the apical position and ideally rests on the surface of the spherical member (22) at the same time that it makes contact with all three puzzle pieces A, D and G which are uppermost in the three hollow members.

The relative dimensions of the various components shown in FIG. 1 are governed by a number of factors particularly the ratio of the common radius (r) of the ten puzzle pieces to the radius (R) of the spherical member (22). There is a unique ratio of r:R which satisfies two requirements, the first being contact of all puzzle pieces with all neighboring puzzle pieces and the second being contact of all puzzle pieces with the spherical member (22). This unique ratio for the particular device shown in FIG. 1 is 0.73. For purposes of constructing a preferred embodiment of the device shown in FIG. 1 a somewhat larger ratio is chosen in order to allow greater flexibility in operativeness of the puzzle.

In a preferred embodiment of a device shown in FIG. 1, constructed with a radius ratio (r:R) somewhat greater than 0.73, (for example, with a ratio of 0.75), all ten puzzle pieces are still substantially in contact with all neighboring puzzle pieces but small gaps are present between the spherical member (22) and some of the puzzle pieces, specifically B, E and H (which rest on the lowermost puzzle pieces C, F and J). The magnitude of the gaps is not critical but, once a specific radius ratio (r:R) has been selected for purposes of construction, the potential magnitude of the gaps is thereby defined.

In a preferred embodiment of the device shown in FIG. 1 the radius ratio (r:R) is conveniently chosen from, although not restricted to, the range 0.75 to 0.80.

The other factor which influences the magnitude of the gaps is the cross-sectional area of the passageways formed by the hollow members and here also some variation is possible without affecting the ability of the puzzle to perform. Thus, if the passageways in said hollow members have cross-sections which are relatively small and tend to hold the puzzle pieces in closer contact with the spherical member (22) the effect is to diminish the gaps between the spherical member and puzzle pieces B, E and H and raise the apical puzzle piece so that it no longer makes contact with the spherical member (22). If the cross-sectional area of the hollow members is relatively large and permits more latitude for sideways movement of the puzzle pieces the effect is to enlarge the gaps between the spherical member (22) and puzzle pieces B, E and H and lower the uppermost puzzle pieces A, D and G so that the apical puzzle piece K makes contact with only two of them instead of all three.

Variations of the device shown in FIG. 1 include variations in the number of channels and the number of puzzle pieces within each channel and these variations are specified more fully below. But the general principles described above hold in determining the dimensions of all these devices by first deriving mathematically a value for the radius ratio corresponding to the double requirement of contact of all puzzle pieces with all neighboring puzzle pieces and contact of all puzzle pieces with a central spherical member. A radius ratio somewhat larger than this mathematical ratio is chosen for the construction of a preferred embodiment of the particular device under consideration.

Figure 6:
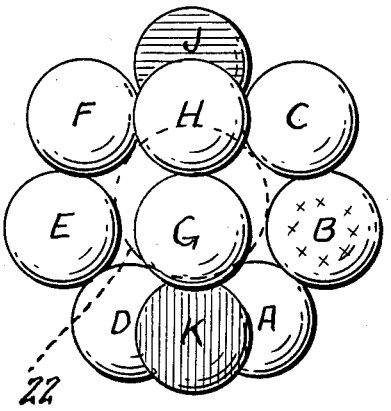
FIG. 6 is a schematic representation of rearranged puzzle pieces after rotation through 180° of the puzzle device shown in FIG. 1.

The mode of operating the puzzle of the invention will now be described with reference to the schematic representations shown in FIGS. 5 and 6. In FIG. 5, as pointed out before, there is shown the particular arrangement of the ten puzzle pieces within the embodiment of FIG. 1 without showing the structure housing the puzzle. The ten puzzle pieces surround the central member (22) shown in dotted outline. FIG. 6 shows the manner in which the various puzzle pieces are rearranged when the puzzle (10) shown in FIG. 1 is rotated backwards through an angle of 180° in the plane of the channel member (16). It will be seen that the puzzle piece K, which was originally the apical puzzle piece, has now become the lowermost member present in the channel member (16). The puzzle piece J, which was originally the lowermost puzzle piece in said channel (16) has become the apical member after the rearrangement has been completed. However, it is to be noted that the arrangement of puzzle pieces, apart from the interchanging, is still in the form of a symmetrical polyhedron of the same shape as the original arrangement prior to the rotation.

As will be apparent to one skilled in the art, if a second rotation of the device through an angle of 180° is carried out but this time making the rotation in the plane of the channel (14), i.e. the channel which holds the puzzle pieces D, E and F in the arrangement shown in FIG. 6, the apical member J will now become the lowermost member in the channel in question and the puzzle piece D, which was originally the lowermost member in the channel in the arrangement shown in FIG. 6, will become the apical member of the arrangement. It will thus be apparent that, by carrying out successive rotations of 180° in any particular direction, it is possible to transfer puzzle pieces from one channel to another. It is thereby possible to change any particular starting arrangement of the relative positions of the various puzzle pieces one with another, but still retain the overall symmetrical polyhedron arrangement of the ten puzzle pieces. A relatively straightforward game can therefore be provided by arranging the ten puzzle pieces in three groups of three, each of which groups is designated, for example, by a single color which is different from the color of any of the other two groups, or by applying markings such as indicia on the various groups in question to distinguish them one from another, always leaving one of the ten pieces characterized by a different color or marking from any of the others. The challenge of the game would be to convert the various puzzle pieces from a random arrangement to a particularly specified arrangement in which, for example, each of the members of a group which bear the same markings are required to be located within the same channel member with the odd puzzle piece located in the apical position. More difficult puzzles can be provided by having three groups of three puzzle pieces each of which group is identified by a color which is graded in shade within the three members. The object of such a game could be, for example, to arrange the three groups of puzzle pieces of the same colors in the same channels but ordered in the degree of shading.

Figure 4:
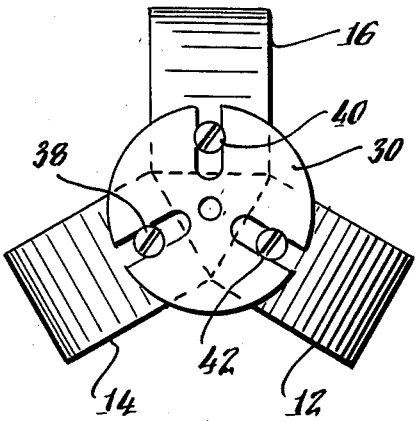
FIG. 4 is a horizontal plan now looking down at the top of a modification of the embodiment shown in FIG. 1.

Other variations on the types of games which can be played with the device will be readily apparent to those skilled in the art. In operating the game the latter can, of course, be held by the player during play or can be placed on a horizontal surface using the end plates (18) and (20) in order to rest the device on the surface between rotations. In order to serve this purpose, the end plates in question can take a variety of forms serving either a functional use or an aesthetic use, or both. For example, there can be employed an end plate of the type shown in FIG. 4 which is a plan view taken from a modified embodiment of the device shown in FIG. 1 looking vertically down at the end plate (18) shown therein. In the modification shown in FIG. 4 the end plate (30) takes the form of a circular disk provided with slots (32), (34) and (36) which serve to hold, in slidable engagement set screws (38), (40) and (42) which latter hold in place the ends of the channel members (12), (14) and (16). This permits the latter channel members to be held in any given relative position and particularly enables the gap between the adjoining edges of these channel members to be adjusted as desired. In a preferred embodiment, the set screws (38), (40) and (42) are adapted to be flush with the surface of the end plate (30) and, more preferably, are recessed below said surface by any appropriate means. The particular embodiment of an end plate and support means shown in FIG. 4 is offered for purposes of illustration only. The mode of construction and design of this end plate, which also serves as a support member for the game device of the invention, is not critical and can take any other appropriate form.

Figure 7:
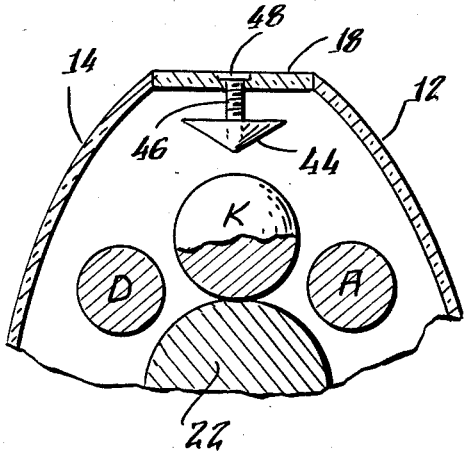
FIG. 7 is a partial, vertical cross-sectional view, taken along the line Y—Y, of the puzzle device shown in FIG. 1.

The spaces beneath the end plates (18) and (20) in the embodiment shown in FIG. 1, which are the locations at which the ends of the three hollow members (12), (14) and (16) come together, take the form of chambers which serve to provide the means through which puzzle pieces can be transferred from one of the channels formed by the hollow members to another of said channels. In the particular construction shown in the embodiment of FIG. 1 it is desirable to restrict the actual configuration of the chambers in question in order to prevent one of the puzzle pieces from sliding by an adjoining piece as they pass through the chamber. It is also possible, unless the dimensions of the chamber are restricted in certain cases, that two or more of the puzzle pieces could become jammed in the chamber during a rotation of the device. FIG. 7 shows, in partial cross-section, a suitable means for controlling the dimensions of the chamber in question. In the cross-sectional view shown in FIG. 7 a conical member (44) is provided with the apex of the cone pointing downwardly toward the spherical member (22). In a preferred embodiment the location of the conical member (44) can be adjusted by mounting the same on a threaded screw (46) which has a screw head (48) inset into the outer side of end plate (18) so that the height of the cone (44) above the spherical member (22) can be adjusted from outside the game device. In addition to restricting the available space in the chamber beneath the end plate (18), the conical member (44) also serves as a guide means for directing the apical member K into any desired channel member during rotation of the game device.

While the game device of the invention has been illustrated above in terms of three channels and a total of ten puzzle pieces, three of which are located in each of the channels and one is kept as the apical member, it will be apparent to one skilled in the art that the game device can be adapted to employ other than three such channels and to employ other than three puzzle pieces in any given channel. The total number of such channels which can be disposed about a central spherical member such as (22) is limited solely by the difficulty of supporting an apical puzzle piece by more than about five such channels around a central spherical member.

Illustrative of the various combinations of numbers of channels and numbers and arrangements of puzzle pieces are the particular arrangements shown in the following tabulation.

| Total no. of pieces | No. of channels | No. of pieces in each channel |
|---|---|---|
| 5 | 2 | 2 |
| 7 | 2 | 3 |
| 9 | 2 | 4 |
| 11 | 2 | 5 |
| 7 | 3 | 2 |
| 10 | 3 | 3 |
| 13 | 3 | 4 |
| 16 | 3 | 5 |
| 9 | 4 | 2 |
| 13 | 4 | 3 |
| 17 | 4 | 4 |
| 21 | 4 | 5 |
| 11 | 5 | 2 |
| 16 | 5 | 3 |
| 21 | 5 | 4 |
| 26 | 5 | 5 |

It will be appreciated that the embodiments which only have two channels offer very little challenge as puzzles and are inserted here only for purposes of illustration.

While the device described above has been discussed in terms of its utility as a puzzle, it is to be pointed out that the particular device illustrated in FIG. 1 can also serve to demonstrate the molecular arrangement of a particular chemical, namely that known as bullvalene. The latter compound was synthesized by W. von E. Doering et al., Tetrahedron, 1963, 19 715. This molecule is of interest in that it contains exactly ten CH units bound together and oriented spatially in a polyhedral form substantially as shown for the ten puzzle pieces in the device of FIG. 1. These ten units are bound together by a combination of double and single bonds which are in a constant state of flux. The device shown in FIG. 1 is an elegant method of demonstrating this particular molecular arrangement and the facility with which the groups can interchange and yet retain the same overall spatial polyhedral form.

While the game device of the invention has been illustrated by reference to a number of specific embodiments as set forth above, it is to be understood that these embodiments have been shown for purposes of illustration and are not to be construed as limiting in any way the scope of the invention. The latter is defined only by the claims which are set forth hereinafter.

The overall size of any device in accordance with the invention is clearly not restricted but is preferably such that it can be comfortably held in the hand.

As will be readily apparent to one skilled in the art, a variety of modifications can be made in the particular embodiments set forth above without departing from the scope of the invention.

Thus, the various embodiments described above have referred to preferred sets of contacts and a range of contacts of the puzzle pieces with neighboring puzzle pieces and with the spherical member (22), but the scope of the invention is not limited to the range of contacts so presented. Illustratively, devices falling within the scope of the invention can be constructed in which the three lowermost puzzle pieces are neither in contact with each other nor with the spherical member (22).

Further, while the central member (22) illustrated in the specific embodiment discussed above has throughout been referred to as spherical, it need not be exactly spherical and it could be, for example, a dimpled sphere or a spheroidal or polyhedral core resembling a sphere. It is the configuration of the outer surface of the central member which is important and it could, for example, be solid or hollow.

Many modifications are possible in the design of the hollow channels. In the device shown in FIG. 1 these channels are shown as symmetrical with respect to both horizontal and vertical planes of the device but other less symmetrical dispositions are possible, for example, dispositions in which the channels are twisted. Further, the hollow channels in the embodiments discussed are shown as rectangular in horizontal cross section and circularly segmented in vertical cross section but other configurations can be employed without in any way departing from the scope of the invention. For example circularly oblong horizontal cross-sections and/or elliptically or parabolically segmented vertical cross sections can be employed. The cutouts which are provided in the adjoining edges of the hollow members may have other configurations, for example rectangular. Cutouts are not required at all for those variations of the device which automatically generate enough space for the central spherical member to move freely as, for example, in a device of the invention with three puzzle members in each of five channels.

In the case of the particular device shown in FIG. 1 the puzzle pieces are smaller in diameter than the spherical member (22). This is not so for all embodiments. For example, a device with two puzzle pieces in each of three channels will have a radius ratio (r:R) of 1.32.

While the invention has been illustrated above by reference to a number of specific embodiments it is to be understood that the scope of the invention is not limited thereby and is defined only by the scope of the following claims.

What is claimed is:

1. A puzzle comprising:

a plurality of hollow arcuate members disposed about a substantially spherical member and cooperating therewith to form a series of channels;

each of said channels communicating, at each end thereof, with each of the other said channels via common chambers;

said common chambers being disposed on substantially diametrically opposed sides of said spherical member;

a plurality of substantially spherical puzzle pieces of substantially uniform size disposed throughout each of said channels;

an additional substantially spherical puzzle piece of the same size as the other said puzzle pieces;

said additional puzzle piece being located in the uppermost of said common chambers, when said puzzle is oriented with said common chambers disposed on a vertical axis, and being supported by contact with at least one of the uppermost puzzle pieces in said channels;

the relative positions of said puzzle pieces and said additional puzzle piece being changeable incrementally upon rotation of said puzzle device through 180° in the plane of any one of said channels with said common chambers disposed on a vertical axis before and after rotation.

2. A puzzle according to claim 1 wherein, upon said rotation through 180°, the puzzle piece located in the uppermost chamber prior to said rotation is caused to enter one of said channels and one of said puzzle pieces originally located in the lower end of the same channel prior to rotation is caused to enter the common chamber which is uppermost after the rotation has been completed.

3. A puzzle according to claim 1 which also comprises support means associated with each of said common chambers said support means being adapted to maintain said puzzle oriented with said chambers disposed on a vertical axis when either of said support means is resting on a horizontal surface.

4. A puzzle according to claim 1 wherein guide means are provided in each of said common chambers to facilitate passage of said puzzle pieces therethrough during rearrangement of the relative positions of said puzzle pieces.

5. A puzzle according to claim 1 wherein said puzzle pieces are divided into groups and the members of each group have visually identifiable characteristics which distinguish them from members of each of the other groups.

6. A puzzle according to claim 5 wherein the members of each group are identified by a color which distinguishes them from members of each of the other groups.

7. A puzzle according to claim 5 wherein the members of each group are identified by indicia which distinguish them from members of each of the other groups.

8. A puzzle according to claim 5 wherein one of the spherical puzzle pieces is identified by visually distinct markings not possessed by any one of the other said puzzle pieces.

9. A puzzle according to claim 1 wherein said hollow arcuate members are fabricated from transparent plastic.

10. A puzzle comprising:

a plurality of transparent hollow arcuate members disposed substantially symmetrically about a substantially spherical core and forming therewith a series of channels of substantially uniform cross-section which interconnect with one another at two locations disposed on substantially diametrically opposed sides of said spherical core;

support means associated with each of said locations of interconnection and adapted to maintain the longitudinal axes of said channels in a vertical plane when either of said support means is resting on a horizontal surface;

a plurality of spherical puzzle pieces of substantially uniform size distributed in surface to surface contact throughout all of said channels, said spherical puzzle pieces having a diameter less than that of the cross-section of said channels but sufficiently large to prevent any two such pieces passing each other within a channel; and one of said spherical pieces being located in the uppermost of said locations of interconnection and being supported by contact with the uppermost of said spherical pieces in at least one of said channels when said puzzle is supported on a horizontal surface.

11. A puzzle according to claim 10 wherein said spherical puzzle pieces are divided into groups and the members of each group have visually identifiable characteristics which distinguish them from members of each of the other groups.

12. A puzzle according to claim 11 wherein the members of each of said groups are identified by a color which distinguishes them from members of each of the other groups.

13. A puzzle according to claim 11 wherein the members of each group are identified by indicia which distinguish them from members of each of the other groups.

14. A puzzle according to claim 11 wherein one of said spherical puzzle pieces is identified by visually distinct markings not possessed by any one of the other of said puzzle pieces.

15. A puzzle according to claim 10 wherein adjustable guide means are provided in each of said locations of interconnection to facilitate passage of said puzzle pieces therethrough during rearrangement of the relative positions of said puzzle pieces.

16. A puzzle according to claim 10 wherein there are at least two hollow arcuate members each of the channels formed thereby being adapted to accommodate at least two spherical puzzle pieces.

17. A puzzle according to claim 16 wherein there are three hollow arcuate members and each of the channels thereby formed accommodates three spherical puzzle pieces.

18. A puzzle according to claim 17 wherein the ratio of the radii of the puzzle pieces to the radius of the spherical core is within the range of 0.75:1 to 0.80:1.

* * * * *